United States Patent [19]

Markov

[11] 4,151,909

[45] May 1, 1979

[54] CASE FOR STRINGED MUSICAL INSTRUMENT

[76] Inventor: Albert Markov, 515 W. 59th St., New York, N.Y. 10019

[21] Appl. No.: 894,086

[22] Filed: Apr. 6, 1978

[51] Int. Cl.[2] ..... B65D 25/22; B65D 5/46; A45C 11/00

[52] U.S. Cl. ..... 206/14; 206/314; 229/22; 190/57

[58] Field of Search ..... 206/14, 314; 190/57; 220/94 R, 334, DIG. 12; 224/31, 32 A, 46 R, 47; 229/22

[56] References Cited

U.S. PATENT DOCUMENTS

| | | | |
|---|---|---|---|
| 344,508 | 6/1886 | Tuttle | 206/14 |
| 386,442 | 7/1888 | Van Winkle | 206/14 |
| 838,952 | 12/1906 | Crabill | 190/57 X |
| 1,840,354 | 1/1932 | Geib | 206/314 |
| 2,845,155 | 7/1958 | Sneyd-Kynnersley | 190/57 |
| 3,731,869 | 5/1973 | Griffin | 229/22 |

*Primary Examiner*—Davis T. Moorhead
*Attorney, Agent, or Firm*—Alvin Sinderbrand

[57] ABSTRACT

A case for a stringed musical instrument has its enclosure or body in the form of a right triangular prism to present spaced apart parallel panels with right triangular perimeters and a peripheral wall extending between such perimeters of the panels and having right angularly related portions with contiguous ends, and preferably of different lengths, and a diagonal portion extending between the other ends, and the carrying handle extends from the peripheral wall at a location between the ends of the diagonal portion which is selected so that with the longer of the right angularly related portions of the peripheral wall extending substantially vertical, the handle will be substantially in vertical alignment with the center of gravity of the case with the instrument therein.

4 Claims, 3 Drawing Figures

CASE FOR STRINGED MUSICAL INSTRUMENT

BACKGROUND OF THE INVENTION

1. Field of the Invention

This invention relates generally to cases for musical instruments, and more particularly is directed to an improved case for a stringed musical instrument, such as, a violin, viola or the like.

2. Description of the Prior Art

Existing cases for stringed musical instruments usually include an enclosure or body that generally follows the contours of the instrument to be contained therein. Thus, a case for a violin, viola or other similar stringed musical instrument is conventionally provided with an enclosure made up of spaced apart panels of similar planform each having a relatively wide portion with an irregularly curved edge or perimeter generally corresponding to the similarly irregularly curved perimeter of the sounding board of the instrument and a relatively narrow portion generally corresponding to the neck or fingerborad of the instrument, and a peripheral wall extending between the perimeters of the panels and having similar irregular curvatures which are outwardly convex at the opposite ends of the elongated enclosure. A carrying handle for the case extends from its peripheral wall intermediate the ends of the enclosure or body for carrying the case its longitudinal axis extending substantially horizontal.

The above described conventional case for a stringed musical instrument has the following disadvantages. When being carried with the longitudinal axis of the case extending generally horizontal, substantial end portions of the case project forwardly and rearwardly beyond the figure of the person carrying the same to make it difficult for such person to move through crowds of people or relatively confined spaces and further making the case susceptible to accidentally inflicted blows or impacts which can damage the instrument contained therein. When the conventional case is to be deposited on a floor or other horizontal support surface, the rounded ends of the enclosure or body dictate that the case be again disposed with its longitudinal axis extending horizontally. When thus laid down, the case occupies an undesirably large floor space and, if in a crowded room or conveyance, the low-lying case is not readily visible and, therefore, is susceptible to being stepped upon, kicked or otherwise damaged. Moreover, by reason of the irregular curvature of the peripheral wall of the conventional case and the inclusion of outwardly concave portions therein, the case is not adapted to readily shed rain or snow when being carried in inclement weather with the result that water may leak into the interior of the case and cause serious damage to the contained instrument.

In U.S. Pat. No. 386,442, issued July 17, 1888, it has been proposed to provide a violin case which tapers slightly in a uniform matter from end to end, and in which both its ends are made flat so as to facilitate its standing on end when not in use for minimizing the space required for storage of the violin case. The case disclosed in this patent is further provided with a strap handle extending therefrom across one end so that, if desired, the instrument case may be carried endwise, that is, suspended vertically downward from the strap handle at one end. However, due to the described positioning of the strap handle at one end of the violin case, the full length of the latter extends downwardly from the hand grasping the strap handle. Therefore, in order to maintain clearance between the lower end of the violin case and the floor or ground, it is ncessary that the arm of the person carrying the case be held in a bent or crooked position with resultant fatigue.

OBJECTS AND SUMMARY OF THE INVENTION

Accordingly, it is an object of the present invention to provide a case for a stringed musical instrument, such as, a violin, viola or the like, which avoids the above-described disadvantages of cases previously in use or proposed for such instruments.

More particularly, an object of this invention is to provide a case for a stringed musical instrument which is capable of being conveniently and comfortably carried in such a manner as to minimize the possibility of damage to the case or to an instrument contained therein while being carried, and further to minimize the extent to which the case impedes movements of the person carrying the same.

Another object is to provide a case for a stringed musical instrument, as aforesaid, which may be easily stored or laid to rest in an erect, stable position so as to occupy a minimal floor space, and further in which the case affords maximum protection from damage to the contained instrument due to falling objects when the case is thus stably disposed in an erect position.

Still another object is to provide a case for a stringed musical instrument, as aforesaid, in which the case can be comfortably and conveniently carried with minimum fatigue due to the possibility of maintaining the hand and arm carrying the case in a relaxed and natural position.

A further object is to provide a case for a stringed musical instrument, as aforesaid, which inherently sheds rain or snow when being carried in inclement weather so as to avoid the possibility of water damage to the contained instrument.

A still further object is to provide a case for a stringed musical instrument, as aforesaid, which has a configuration contributing to its relatively low-cost manufacture and durability.

In accordance with an aspect of this invention, a case for a stringed musical instrument comprises an enclosure or body including spaced apart, substantially parallel panels with right triangular perimeters and a peripheral wall extending between such perimeters of the panels and having right angularly related portions with contiguous ends and a diagonal portion joined at its ends with the other ends of the right angularly related portions, and a carrying handle extending from the peripheral wall at a location on the diagonal portion of the latter between the ends of such diagonal portion.

In a preferred embodiment of the invention, the triangular perimeter of each of the panels of the enclosure has sides of unequal lengths so that the right angularly related portions of the peripheral wall are similarly of unequal lengths, and the carrying handle is disposed along the diagonal portion of the peripheral wall, so that, with the longer one of the right angularly related portions of the peripheral wall extending substantially vertical, a vertical line through the center of gravity of the case with an instrument therein will pass substantially through the handle.

The above, and other objects, features and advantages of the invention, will be apparent in the following detailed description of an illustrative embodiment which is to be read in connection with the accompanying drawing.

DETAILED DESCRIPTION OF THE DRAWING

Figure 1:
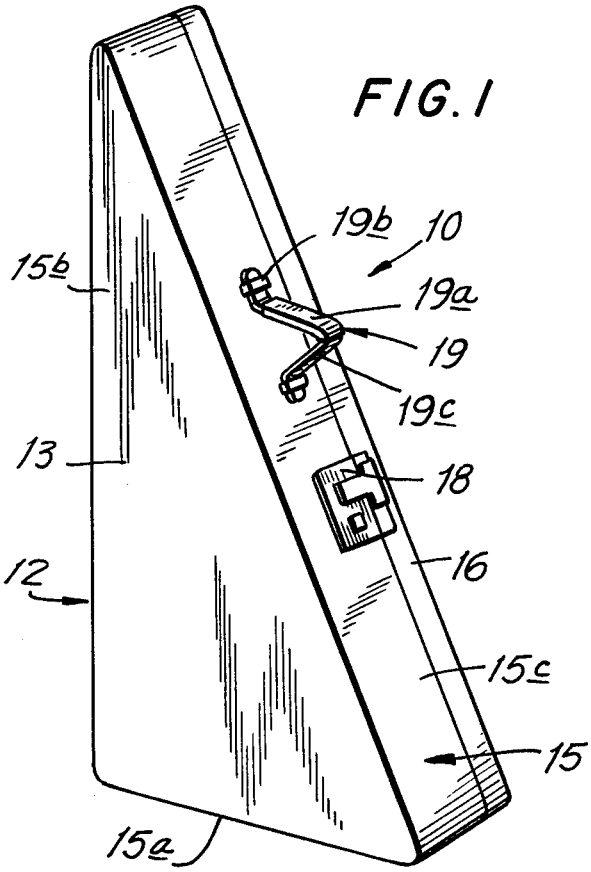
FIG. 1 is a perspective view of a case for a stringed musical instrument in accordance with an embodiment of this invention, and which is shown closed and standing in its normal erect position, as on a floor or other supporting surface.
Figure 2:
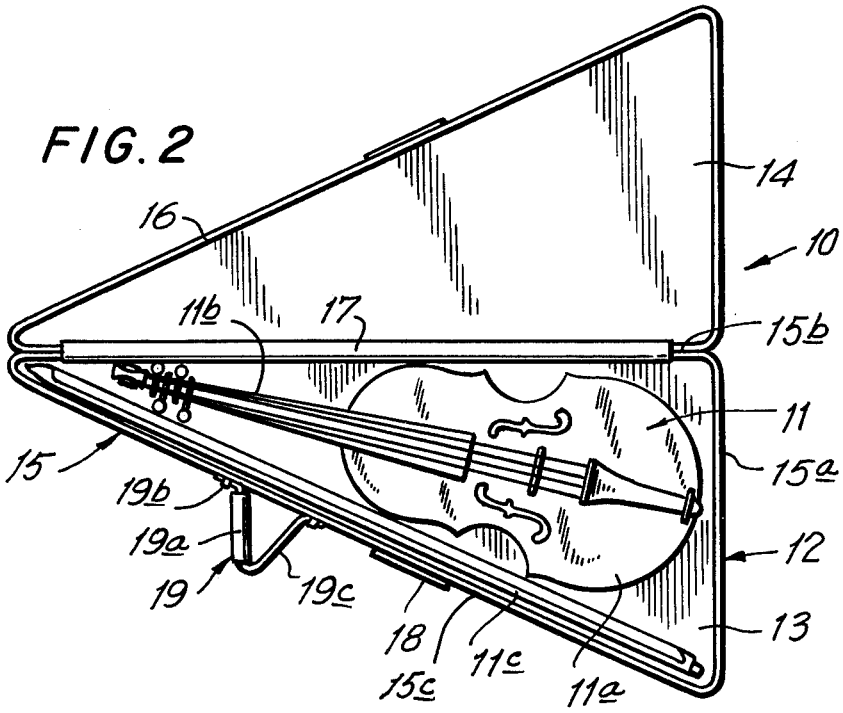
FIG. 2 is a plan view of the case of FIG. 1 shown opened and with a violin and bow therein.

Referring to the drawing in detail, it will be seen that a case 10 according to this invention for a stringed musical instrument, such as, a violin as indicated at 11 on FIG. 2, a viola or the like, comprises an enclosure 12 having the confuguration of a right triangular prism. More particularly, the enclosure 12 is shown to include panels 13 and 14 (FIG. 2) with similar right triangular perimeters which are in spaced apart, substantially parallel relation in the closed condition of enclosure 12 (FIG. 1), and a peripheral wall 15 extending between the perimeters of panels 13 and 14 in the closed condition of the enclosure. The peripheral wall 15 is shown to have right angularly related portions **15*a* and 15*b* (FIG. 2) with ends that are contiguous at the right angled corner of the right triangular prism and a diagonal portion 15*c* joined at its ends to the ends of portions 15*a* and 15*b*** remote from the right angled corner of the prism.

In the illustrated embodiment of the invention, peripheral wall 15 is joined integrally to the panel 13 at the perimeter of the latter, while the other panel 14 is provided with a rim 16 along its perimeter to form a lid which is hingedly connected to peripheral wall 15, for example, by a flexible fabric or leather hinge 17 shown to extend along portion **15*b* of peripheral wall 15 and the corresponding portion of rim 16. It will be appreciated that the lid constituted by panel 14 and its rim 16 can swing relative to the remainder of enclosure 12 about an axis extending along peripheral wall portion 15*b* between the opened position shown on FIG. 2 and the closed position shown on FIG. 1 in which panels 13 and 14** are parallel and spaced apart from each other.

As is apparent from the drawing, the triangular perimeter of each of panels 13 and 14 preferably has sides of unequal lengths so that the right angularly related portions **15*a* and 15*b* of peripheral wall 15 are similarly of unequal lengths, with at least the shorter of the right angularly related portions of peripheral wall 15, that is, the wall portion 15*a*, being substantially flat. Thus, with enclosure 12 in its closed condition, it can stand erect on the relatively short flat portion 15*a* of its peripheral wall. Further, as shown, a suitable lock or latch 18 is provided for securing enclosure 12** in its closed condition.

The dimensions of enclosure 12 are selected so that, for example, the full-sized violin 11 can be accommodated therein with the body or sounding board **11*a* of the violin disposed between the relatively widely spaced or diverging parts of peripheral wall portions 15*b* and 15*c* while the neck or fingerboard 11*b* of the instrument extends between the converging parts of such wall portions. Further, one or more bows 11*c* may be disposed in enclosure 12 along peripheral wall portion 15*c*. It has been found that, when enclosure 12 is to accommodate a full-sized violin 11, as aforesaid, peripheral wall portions 15*a* and 15*b* may have lengths of approximately 13 and 28 inches, respectively, while the distance between panels 13 and 14** in the closed condition is approximately 4 inches.

Further, in accordance with this invention, a carrying handle 19 extends from peripheral wall 15 at a location on diagonal portion **15*c* between the ends of the latter. Preferably, the carrying handle 19 is disposed along diagonal peripheral wall portion 15*c* so that, with peripheral wall portion 15*b*, that is, the longer of the right angularly related peripheral wall portions 15*a* and 15*b*, extending substantially vertical, as on FIG. 3, a vertical line 20 through the center of gravity C.G. of the case 10 with instrument 11 therein passes substantially through the handle 19. As is shown particularly on FIGS. 1 and 2, the carrying handle 19 desirably has a padded portion 19*a* secured at one end, as at 19*b*, to diagonal wall portion 15*c* and extending therefrom substantially parallel with the relatively shorter wall portion 15*a* on which the enclosure 12 is intended to rest in an erect position. Further, the outer end of padded portion 19*a* of the handle 19 is joined to diagonal wall portion 15*c* by a sloping handle extension or connection 19*c***.

It will be apparent that, when the violin 11 or other stringed instrument is disposed in enclosure 12 and the latter is disposed erect on its relatively short peripheral wall portion **15*a*, as on FIG. 1, the case is stable and occupies a relatively small surface. Due to the right triangular prismatic shape of enclosure 12, the latter is relatively easily and inexpensively manufactured, as compared with the difficulties and costs encountered in producing the conventional violin case with complex curvatures. Furthermore, providing the enclosure 12 with the configuration of a right triangular prism ensures that such enclosure will have the rigidity and strength requisite to protect the contained instrument. It is also to be appreciated that, when enclosure 12 rests in the erect position shown on FIG. 1, its diagonal or sloping peripheral wall portion 15*c* ensures that any object falling from above onto the case will glance off such inclined wall portion 15*c* for minimizing damage to the case and to the contained instrument. Moreover, with enclosure 12 in its normal erect position of FIG. 1, the only surface thereof having an upwardly directed horizontal projection is the diagonal peripheral wall portion 15*c* which is steeply inclined so as to effectively shed any rain or snow falling thereon. Thus, the case 10 according to this invention can be exposed to rain, snow or sleet without the danger that retained water will seep between rim 16 and peripheral wall 15** and cause water damage to the contained instrument.

Figure 3:
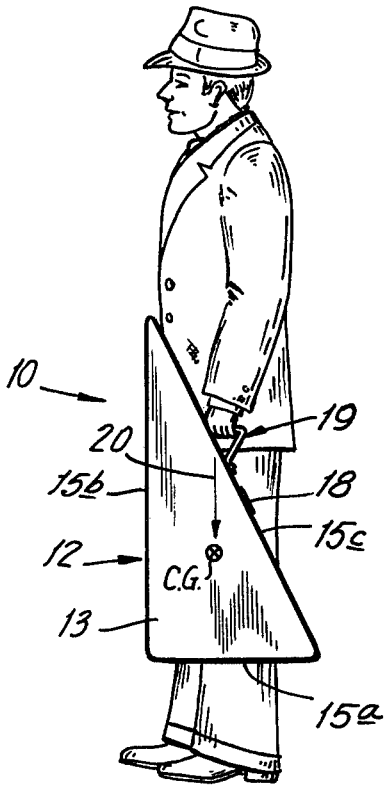
FIG. 3 is a side elevational view showing the manner in which the case of FIGS. 1 and 2 may be conveniently carried.

When case 10 with a stringed instrument therein is to be carried or transported, handle 19 is merely grasped, as shown on FIG. 3 and, by reason of the previously described relationship of the center of gravity C.G. of the case and the instrument therein in respect to the handle, enclosure 12 automatically assumes the erect position shown on FIG. 3 in which peripheral wall portion **15*b* is substantially vertical and the short peripheral wall portion 15*a* is disposed at the bottom of the enclosure. With enclosure 12 having the foregoing orientation when case 10 is being carried, padded portion 19*a* of carrying handle 19 extends substantially in the horizontal direction for convenient grasping by the hand of the person carrying the instrument case. Furthermore, due to the diagonal arrangement of peripheral wall portion 15*c*, the desired vertical alignment of the handle 19 and of the center of gravity C.G. of the case is achieved with handle 19 spaced substantially downward from the upper end of wall portion 15***c*. Therefore, the peripheral wall portion 15*a* at the bottom of enclosure 12 can have a substantial clearance from the floor or ground even though the hand and arm of the person carrying the case 10 are allowed to hang loosely in relaxed natural positions, as shown on FIG. 3. It will also be appreciated that, by reason of the inherent positioning of the enclosure 12 in the erect position shown on FIG. 3 when the case is being carried, the case does not project substantially forward or rearward beyond the body of the person carrying the same. Therefore, movements of the person carrying the case 10 are not substantially impeded by the latter, even when in a crowded room or conveyance, and the case 10 is relatively less likely to be struck or subjected to severe impact when being carried or transported.

Although an illustrative embodiment of the invention has been described in detail herein with reference to the accompanying drawing, it is to be understood that the invention is not limited to that precise embodiment, and that various changes and modifications may be effected therein by one skilled in the art without departing from the scope or spirit of the invention as defined in the appended claims.

What is claimed is:

1. A case for a stringed musical instrument; comprising an enclosure including spaced apart, substantially parallel panels with right triangular perimeters and a peripheral wall extending between said perimeters of the panels and having right angularly related portions with contiguous ends and a diagonal portion joined at its ends with the other ends of said right angularly related portions, each of said triangular perimeters having sides of unequal lengths so that said right angularly related portions of the peripheral wall are similarly of unequal lengths, and a carrying handle joined to said peripheral wall at a location which is disposed along said diagonal portion and spaced from said ends of the latter so that, with the longer of said right angularly related portions extending substantially vertical, a vertical line through the center of gravity of the case with an instrument therein passes substantially through said handle.

2. A case for a stringed musical instrument according to claim 1; in which at least the shorter of said right angularly related portions of the peripheral wall is substantially flat so that said enclosure can stand erect thereon.

3. A case for a stringed musical instrument according to claim 2; in which said peripheral wall is joined integrally to one of said panels at said perimeter of the latter, and the other of said panels forms a lid which is hingedly connected to said peripheral wall at one of said portions of the latter.

4. A case for a stringed musical instrument according to claim 1; in which said carrying handle extends fron said diagonal portion substantially parallel with the shorter of said right angularly related portions of the peripheral wall.

* * * * *